US008517758B2

(12) United States Patent
Pizzi

(10) Patent No.: US 8,517,758 B2
(45) Date of Patent: Aug. 27, 2013

(54) SWITCHBOARD TERMINAL BLOCK

(75) Inventor: Giordano Pizzi, Milan (IT)

(73) Assignee: Morsettitalia S.p.A., Milan (IT)

( * ) Notice: Subject to any disclaimer, the term of this patent is extended or adjusted under 35 U.S.C. 154(b) by 246 days.

(21) Appl. No.: 13/014,141

(22) Filed: Jan. 26, 2011

(65) Prior Publication Data

US 2011/0183542 A1 Jul. 28, 2011

(30) Foreign Application Priority Data

Jan. 28, 2010 (IT) ..... MI20100017 U

(51) Int. Cl.
*H01R 3/00* (2006.01)

(52) U.S. Cl.
USPC ..... 439/491

(58) Field of Classification Search
USPC ..... 439/94, 491, 532, 716
See application file for complete search history.

(56) References Cited

U.S. PATENT DOCUMENTS

| | | | | |
|---|---|---|---|---|
| 3,753,216 | A * | 8/1973 | Johnson et al. | 439/491 |
| 3,824,553 | A * | 7/1974 | Glover et al. | 439/717 |
| 5,080,607 | A * | 1/1992 | Cristescu | 439/491 |
| 5,419,715 | A * | 5/1995 | Laveissiere | 439/491 |
| 5,594,206 | A * | 1/1997 | Klas et al. | 174/56 |
| 5,735,708 | A * | 4/1998 | Arnett et al. | 439/491 |
| 6,421,941 | B1 * | 7/2002 | Finke et al. | 40/611.05 |
| 6,729,902 | B2 * | 5/2004 | Martich | 439/488 |
| 7,353,629 | B2 * | 4/2008 | Caveney et al. | 40/299.01 |

FOREIGN PATENT DOCUMENTS

| | | | |
|---|---|---|---|
| DE | 2914192 | A1 | 10/1980 |
| DE | 20303475 | U1 | 5/2003 |
| DE | 102008009986 | A1 | 7/2009 |
| FR | 1593558 | A | 6/1970 |

OTHER PUBLICATIONS

European Search Report from EP11121225, dated Apr. 14, 2011.

* cited by examiner

*Primary Examiner* — Neil Abrams
*Assistant Examiner* — Travis Chambers
(74) *Attorney, Agent, or Firm* — Mintz Levin Cohn Ferris Glovsky and Popeo, P.C.

(57) ABSTRACT

A switchboard terminal block including a body with a side face and a front side provided with a seat for labels, the seat having a top edge and bottom edge formed in the manner of a respective tooth, a relief extending in the vertical direction on the front surface of the seat, the seat being open in the transverse direction for insertion of the label from one side or the other. Also, a label for the seat, which has a top edge and bottom edge which can be shaped so as to form a respective projection in the vertical direction and is provided with a cavity on the inner face extending in the vertical direction and with a depth substantially corresponding to the height of the relief on the seat of the terminal block.

10 Claims, 2 Drawing Sheets

SWITCHBOARD TERMINAL BLOCK

CROSS-REFERENCE TO RELATED ACTIONS

This application claims the benefit of and priority to Italian Patent Application No. MI2010U 17, filed Jan. 28, 2010, which is incorporated by reference herein in its entirety

BACKGROUND

In the technical sector relating to the manufacture of switchboards for the wiring of electrical installations, terminal blocks can be used that are designed to be mounted on corresponding support rails and to provide frontal access to the means—typically of the screw type—for retaining the electrical connection wires that form the electric circuit. The increasing complexity of electric switchboards can result in the need to provide each terminal block with a corresponding identification label that should be frontally visible so that it can be read by the user.

SUMMARY

One or more embodiments described herein relate to a switchboard terminal block provided with a label-holder seat, a label for said seat, and a terminal block/label assembly. Preferably, the terminal block and the label should be easy and inexpensive to produce and assemble. Additionally, with regard to the label, it should be able to be made as a continuous strip that can be easily divided. These results can preferably be achieved using one or more embodiments of a switchboard terminal block that includes a seat for a label and a label for said terminal block.

Embodiments of the invention can provide a terminal block for electric switchboards that has a suitable front seat for containing a label, and a corresponding label, which are able to provide easy and stable mutual engagement/disengagement, while having the properties of being safe, preventing accidental removal of the label, and ensuring good visibility by the user.

In general, in an aspect, embodiments of the invention may provide a switchboard terminal block including a body including a side face and a front side, the body defining a seat, the seat being configured to receive a label, wherein the seat includes a top edge and a bottom edge formed in the manner of a respective tooth, each tooth comprising a corresponding undercut towards the inside of the seat, such that the undercut forms a relief extending in the vertical direction on the front surface of the seat, and wherein the seat is open in the transverse direction for insertion of a label from one side or the other.

Implementations of the invention can provide one or more of the following features. Each tooth of the seat extends substantially widthwise in the transverse direction of the seat. The teeth of the seat are disposed facing each other and have a rounded edge. The relief is disposed in a central position with respect to the transverse direction. The terminal block further includes an opening for communication between an exterior and a top inner part of the seat.

In general, in another aspect, embodiments of the invention may provide a label for a corresponding terminal block including a top edge and bottom edge shaped so as to form a respective projection in the vertical direction, in that the dimensions of the label are substantially the same as those of the corresponding seat of the terminal block and in that an inner front face of the label forms a cavity extending in the vertical direction and having a depth substantially corresponding to the height of the relief on the seat of the terminal block.

Implementations of the invention can provide one or more of the following features. The seat extends substantially over the entire width in the vertical direction of the label. The top edge and bottom edge extend substantially along the entire width in the transverse direction of the label. The label comprises a flat sheet-like material. The label comprises paperboard.

These and other capabilities of the invention, along with the invention itself, will be more fully understood after a review of the following figures, detailed description, and claims.

DETAILED DESCRIPTION

Figure 1:
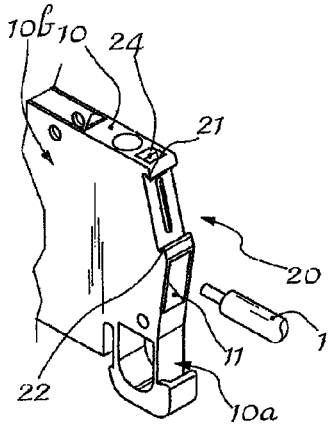
FIG. 1 shows a perspective view of the front side of a terminal block with a label-holder seat.
Figure 1:
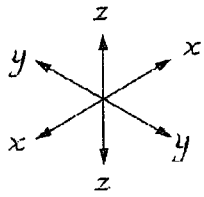
Figure 2:
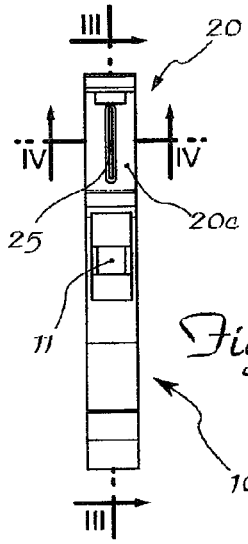
FIG. 2 shows a front view of the terminal block according to FIG. 1.
Figure 3:
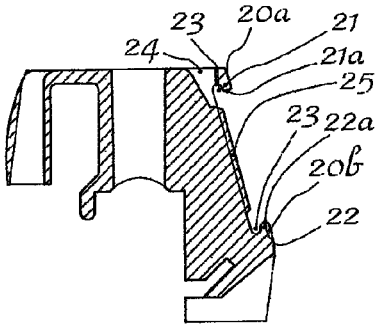
FIG. 3 shows a partial schematic cross-section along the plane indicated by III-III in FIG. 2.
Figure 4:
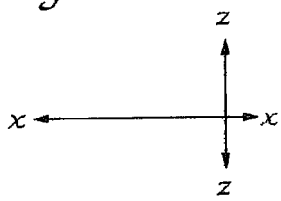
FIG. 4 shows a partial schematic cross-section along the plane indicated by IV-IV in FIG. 2.
Figure 4:
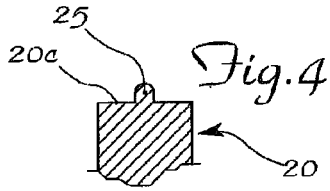
Figure 5:
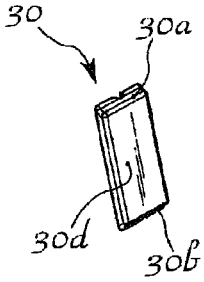
FIG. 5 shows a perspective view of a label for switchboard terminal blocks.
Figure 6:
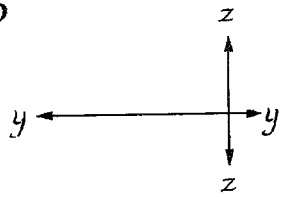
FIG. 6 shows a front view from the inner side of the label according to FIG. 5.
Figure 6:
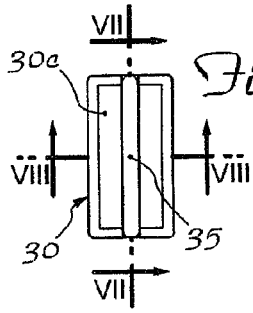
Figure 7:
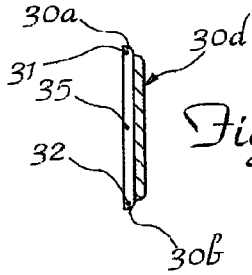
FIG. 7 shows a partial schematic cross-section along the plane indicated by VII-VII in FIG. 6.
Figure 8:
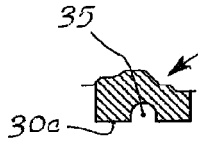
FIG. 8 shows a schematic cross-section along the plane indicated by VIII-VIII in FIG. 6.
Figure 9:
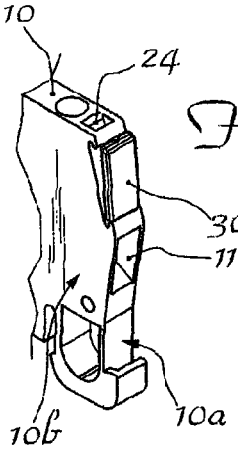
FIG. 9 shows a perspective view of the terminal block/label assembly according to the present invention during insertion of the label.
Figure 10:
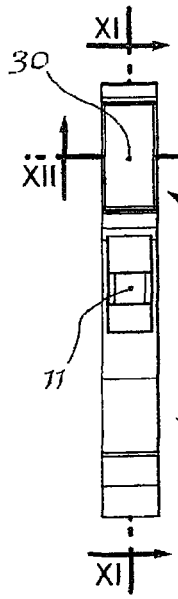
FIG. 10 shows a front view of the assembly according to FIG. 9.

As shown in FIG. 1, and other corresponding figures, and assuming solely for the sake of simplification of the description and without any limitation of meaning, a set of three reference axes in a longitudinal direction X-X, transverse direction Y-Y, and vertical direction Z-Z, respectively, as well as a front side corresponding to the side for reading of the label are shown. A terminal block preferably includes a body 10 with a front side 10*a* and a side face 10*b*. The front side 10*a* preferably includes an opening 11 for inserting the electric wire 1, these parts being conventional and therefore not described in detail. The front side 10*a* of the terminal block is preferably provided with a seat 20 for holding a label 30. The seat preferably has a top edge 20*a* and bottom edge 20*b* formed in the manner of a respective tooth 21, 22 extending widthwise in the transverse direction Y-Y of the seat 20 itself, each tooth forming a corresponding undercut 23.

Preferably the teeth 21, 22 facing each other have a suitably rounded edge 21*a*,22*a*. The front surface 20*c* of the seat 20 can also include a relief 25 extending in the vertical direction Z-Z and preferably arranged in a central position with respect to the transverse direction Y-Y. On the end edge of its top surface (according to the layout shown in FIG. 1) the body 10 can have an opening 24 that connects the exterior with the inner top part of the label-holder seat 20 and, as described more fully below, this opening can allow the introduction of a tool 50.

FIGS. 5 to 8 show an exemplary label 30 that can be suitable for insertion inside the seat 20 of the terminal block described above. The label 30 preferably includes an inner face 30*c*, an outer reading/writing face 30*d*, a top edge 30*a*, and a bottom edge 30*b* shaped so as to form a respective projection 31 and 32. The projections 31,32 preferably extend substantially over the entire width of the label in the transverse direction Y-Y, their dimensions preferably being substantially the same as those of the corresponding seat 20 of the terminal block 10. The front inner face 30*c* of the label can also be provided with a cavity 35 extending in the vertical direction Z-Z and having a depth substantially corresponding to the height of the relief 25 on the seat 20 of the terminal block 10 so as to allow stable mutual engagement.

As shown in FIGS. 9-12, the terminal block/label assembly can be assembled by inserting the bottom edge 30*b* into the bottom undercut 23 of the seat 20 so that the bottom tooth 22 thereof interferes with the bottom projection 32 of the label 30. Once the respective bottom edges are engaged, the label 30 can be pushed frontally in the longitudinal direction X-X so as to force insertion of the top projection 31 of the label inside the top recess 23 of the seat 20 of the terminal block 10, resulting in interference between the top tooth 21 and the top projection 31 of the label. Engagement together in the front direction is preferably facilitated by the small amount of sliding friction between the surfaces, due to the rounded form of the teeth and the projections that come into contact with each other. Once the label 30 has been inserted frontally, its cavity 35 is preferably engaged with the relief 25 on the seat 20, thus also fixing the label in the transverse direction Y-Y and preventing it from accidentally coming out in this direction.

Figure 11:
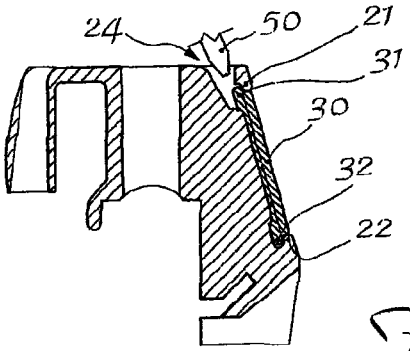
FIG. 11 shows a partial schematic cross-section along the plane indicated by X-X in FIG. 10.
Figure 12:
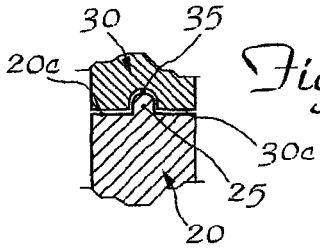
FIG. 12 shows a partial schematic cross-section along the plane indicated by XII-XII in FIG. 10.

As shown in FIG. 11, in order to extract the label, the tip 51 of a tool 50 can be inserted inside the opening 24 of the terminal block 10 so that it pushes out and separates the label which may be extracted without too much difficulty owing to the limited relative friction of the rounded teeth and the flexibility of the label. In addition, the possibility of applying the tool to the rear side of the label avoids damaging the label which can be reused.

Figure 13:
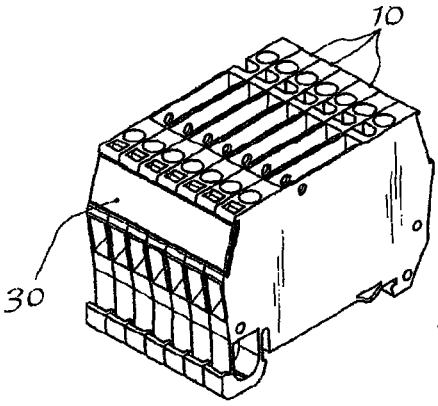
FIG. 13 shows a perspective view of a group of several terminal blocks joined together with the label inserted.
Figure 14:
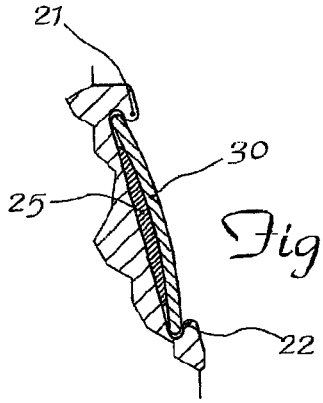
FIG. 14 shows a partial schematic cross-section of the group according to FIG. 13.

As shown in FIGS. 13 and 14 the terminal block with a seat, which is open along the sides, can also allow the insertion/extraction of a label along the sides and both from the right and from the left, this allowing also the labels to be made in strip form such that they can be inserted into groups of terminal blocks joined together in the transverse direction Y-Y.

It is also possible to provide labels without a recess 35 since the force applied by the relief 25 on the label can produce an elastic deformation which creates a reaction in the longitudinal direction X-X in the region of the teeth 21,22 and friction in the transverse direction Y-Y on the protrusion itself such as to retain the label stably inside the seat.

It is therefore clear how the terminal block and the label according to the invention can be easy and inexpensive to produce and can form an assembly in which the label may be easily applied and extracted, while being positioned in a stable and therefore safe and reliable manner. In addition, the particular constructional form of the label is such that it may be made of flat sheet-like materials which are commercially available and of any material such as paperboard or the like, thus reducing significantly the production and storage costs.

Other embodiments are within the scope and spirit of the invention. Features implementing functions may be physically located at various positions, including being distributed such that portions of functions are implemented at different physical locations.

Further, while the description above refers to the invention, the description may include more than one invention.

What is claimed is:

1. A switchboard terminal block comprising:

a body including a side face and a front side, the body defining a seat, the seat being configured to receive a label;

wherein the seat includes a top edge and a bottom edge formed in the manner of a respective tooth, each tooth comprising a corresponding undercut towards the inside of the seat, such that the undercut forms a relief extending in the vertical direction on the front surface of the seat, wherein the seat is open in a transverse direction for insertion of the label from one side or the other; and wherein the label comprises a top edge and bottom edge shaped so as to form a respective projection in the vertical direction, in that the dimensions of the label are substantially the same as those of the corresponding seat of the terminal block and in that an inner front face of the label forms a cavity extending in the vertical direction and having a depth substantially corresponding to the height of the relief on the seat of the terminal block.

2. The terminal block according to claim 1, wherein the relief is disposed in a central position with respect to the transverse direction.

3. The terminal block according to claim 1, further comprising an opening for communication between an exterior and a top inner part of the seat.

4. The label according to claim 1, wherein the seat extends substantially over the entire width in the vertical direction of the label.

5. The label according to claim 1, wherein the top edge and bottom edge extend substantially along the entire width in the transverse direction of the label.

6. The label according to claim 1, wherein the label comprises a flat sheet-like material.

7. The label according to claim 1, wherein the label comprises paperboard.

8. An assembly comprising a switchboard terminal block and a label, characterized in that the former is a terminal block according to claim 1 and the latter is a label according to claim 1.

9. The terminal block according to claim 1, wherein each tooth of the seat extends substantially widthwise in the transverse direction of the seat.

10. The terminal block according to claim 9, wherein the teeth of the seat are disposed facing each other and have a rounded edge.

* * * * *